US006070700A

United States Patent [19]

Nagel

[11] Patent Number: 6,070,700

[45] Date of Patent: Jun. 6, 2000

[54] OPERATING SYSTEM FOR ELEVATOR DOORS

[75] Inventor: Heinz-Dieter Nagel, Berlin, Germany

[73] Assignee: Inventio AG, Hergiswil NW., Switzerland

[21] Appl. No.: 09/283,018

[22] Filed: Apr. 1, 1999

Related U.S. Application Data

[63] Continuation of application No. PCT/CH97/00342, Sep. 16, 1997.

[51] Int. Cl.[7] ..... B66B 13/06

[52] U.S. Cl. ..... 187/335; 187/331; 187/319; 49/120

[58] Field of Search ..... 187/319, 324, 187/330, 333, 334, 331, 335; 49/120, 122

[56] References Cited

U.S. PATENT DOCUMENTS

| | | | |
|---|---|---|---|
| 2,996,152 | 8/1961 | Olexson et al. | 187/319 |
| 3,033,317 | 5/1962 | Beck et al. | 187/319 X |
| 3,554,326 | 1/1971 | Hallene et al. | 187/319 X |
| 3,913,317 | 10/1975 | Kumagai et al. | 187/319 X |
| 5,174,417 | 12/1992 | Pilsbury | 187/330 |
| 5,487,449 | 1/1996 | Barrett et al. | 187/330 |
| 5,544,720 | 8/1996 | Spiess | 187/319 |
| 5,575,357 | 11/1996 | Spiess | 187/330 X |
| 5,690,188 | 11/1997 | Takakusaki et al. | 187/330 X |

FOREIGN PATENT DOCUMENTS

| | | | |
|---|---|---|---|
| 54-140339 | 10/1979 | Japan | 187/330 |
| 4-201968 | 7/1992 | Japan | 187/319 |
| 05162956 | 6/1993 | Japan | 187/330 |
| 712722 | 7/1954 | United Kingdom . | |

*Primary Examiner*—Robert P. Olszewski
*Assistant Examiner*—Thuy V. Tran
*Attorney, Agent, or Firm*—MacMillan, Sobanski & Todd, LLC

[57] ABSTRACT

An operating system placed on the cabin door is shown with a continuous line in rest position and with a dotted line in working position. An arrow marked with a (Y) indicates a horizontal movement undertaken by the operating system in the Y-direction and an arrow marked by (X) indicates a horizontal movement undertaken by the operating system in the X-direction. The X/Y movement of the operating system is produced by an actuator and motive mechanics. On a shaft door is placed an operating cam upon which the operating system rests. Operating system sensors measure the distance to the shaft door and the operating cam. An electromagnet of the operating system produces the necessary force for coupling of cabin door to shaft door.

10 Claims, 7 Drawing Sheets

OPERATING SYSTEM FOR ELEVATOR DOORS

CROSS-REFENCE TO RELATED APPLICATIONS

This application is a continuation of PCT application Ser. No. PCT/CH97/00342, filed Sep. 16, 1997, which claims priority from European Application Serial No. 96810661.7, filed Oct. 3, 1996.

BACKGROUND OF THE INVENTION

The invention relates to an operating system for elevator doors consisting of a magnet movably mounted on a car door, the magnetic field of the magnet acting on a magnetizable operating cam mounted on a hoistway door.

From patent specification U.S. Pat. No. 5,487,449 an operating device has become known by means of which the car door is magnetically coupled with the hoistway door when the car door and hoistway door are opened and closed. The magnetic field of an electromagnet or permanent magnet mounted on the car door acts on a coupler mounted on the hoistway door, as a result of which the doors are coupled by magnetic force, and opened and closed together by means of a door drive. To make the coupling smoother, rollers which can be swiveled are mounted on the magnet, the magnetic force acting against spring forces created by springs mounted on the rollers.

From patent specification U.S. Pat. No. 3,913,270 an operating device has become known which has an electromagnet mounted on the car door in a vertically movable manner. Two guides running in a vertical direction give the electromagnet a limited amount of freedom to move in the vertical direction, the electromagnet being held in the correct position by means of springs. When the car door couples with the hoistway door, the electromagnet acts on an operating rail, which is mounted on the hoistway door in a swiveling manner, the operating rail thereby being drawn toward the electromagnet. When decoupling takes place, the electromagnet is switched off. When this happens, the operating rail, which is supported by swivel arms, is released from the electromagnet and swivels downwards.

A disadvantage of the known device is that the tolerances inherent in the elevator system cannot be sufficiently corrected by the operating device, and there is therefore a danger that the operating device collides with either the hoistway door sill, or parts of the hoistway door lock, while the elevator is in operation, which can cause faults in the elevator and damage to parts of the installation.

SUMMARY OF THE INVENTION

It is in this respect that the invention aims to provide a remedy. The objective of the invention as characterized is to avoid the disadvantages of the known device, and to create an operating system which, while the doors are moving, automatically adjusts different positions occurring within the allowed tolerances of operating elements mounted on the car door, and of operating elements mounted on the hoistway door.

The advantages resulting from the invention relate mainly to the fact that the necessary distance between the car door sill and the hoistway door sill can be minimized, so that the gap between the sills can also be passed over by vehicles with small wheels. An additional advantage is that horizontal movement within allowed tolerances in the X/Y direction caused by loading and unloading the elevator car, and tolerances arising due to wear of the guides and settlement of the building, can be automatically detected and corrected. A further advantage is that pre-opening of the elevator doors while the elevator car is leveling-in to a stop, and traveling in either an upward or downward direction, is possible without certain of the operating elements being subject to especial wear. Advantageous consequences of this are a long service life and freedom from maintenance of the operating system according to the invention.

BRIEF DESCRIPTION OF THE DRAWING

A more detailed description of the invention follows below by reference to drawings illustrating only one embodiment. The drawings show:

FIG. 5*a*–7*a* Alternative positions of the operating cam on the hoistway door.

DESCRIPTION OF THE PREFERRED EMBODIMENT

Figure 1:
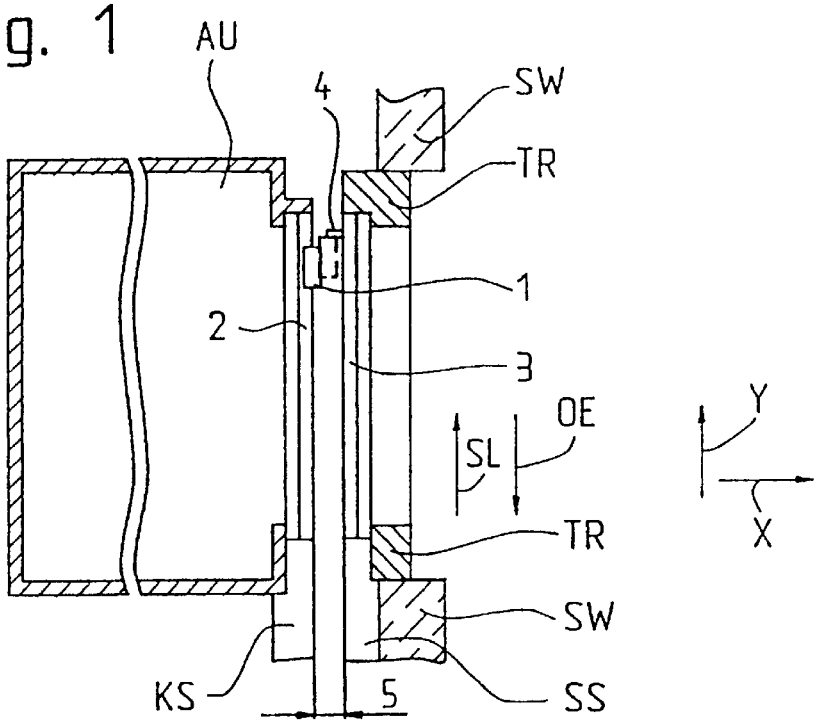
FIG. 1 A plan view of an elevator entrance/exit.

FIG. 1 shows a plan view of an elevator entrance/exit with an elevator car AU standing at a landing. The elevator car AU has a car door 2, which is driven by a door drive (not shown), and which is shown in the drawing in the closed state. The car door 2 has mounted on it an operating system 1, which in its rest position is shown by a continuous line, and in its working position by a broken line. An arrow marked Y indicates the direction of horizontal movement of the operating system 1 in the Y direction, and an arrow marked X indicates the direction of horizontal movement of the operating system 1 in the X direction. An opening in a hoistway wall SW is closed by means of a door frame TR and a hoistway door 3. Mounted on the hoistway door 3, which is shown in its closed state, is an operating cam 4 having a section in the form of an 'L', for example, against which the operating system 1 rests. An arrow marked SL indicates the direction in which the car door 2 and the hoistway door 3 close, and an arrow marked OE symbolizes the direction in which the car door 2 and the hoistway door 3 open. The car door 2 and the hoistway door 3 are each constructed as a sliding door having at least one door panel. The gap between a car door sill KS and a hoistway door sill SS is marked 5.

Figure 2:
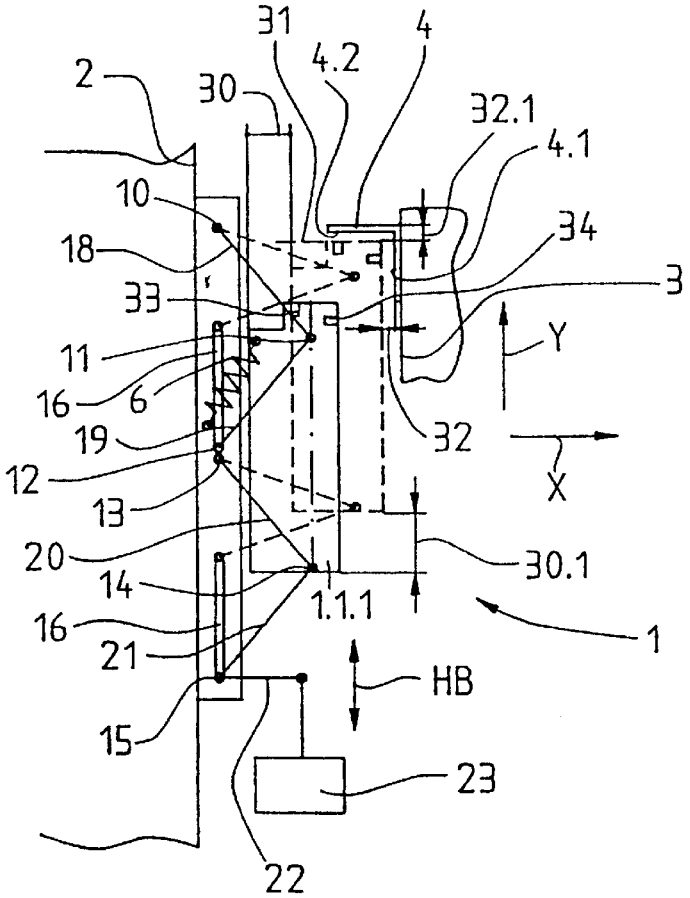
FIG. 2 A schematic plan view of an operating system according to the invention.
Figure 2A:
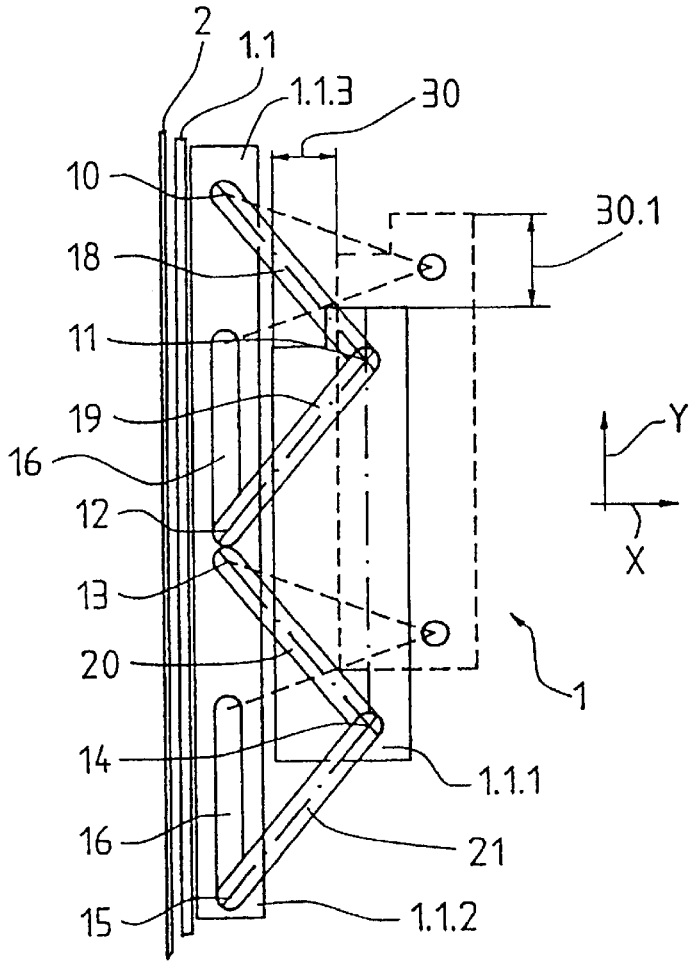
FIG. 2*a* A side view of a motive mechanism of the operating system.
Figure 2B:
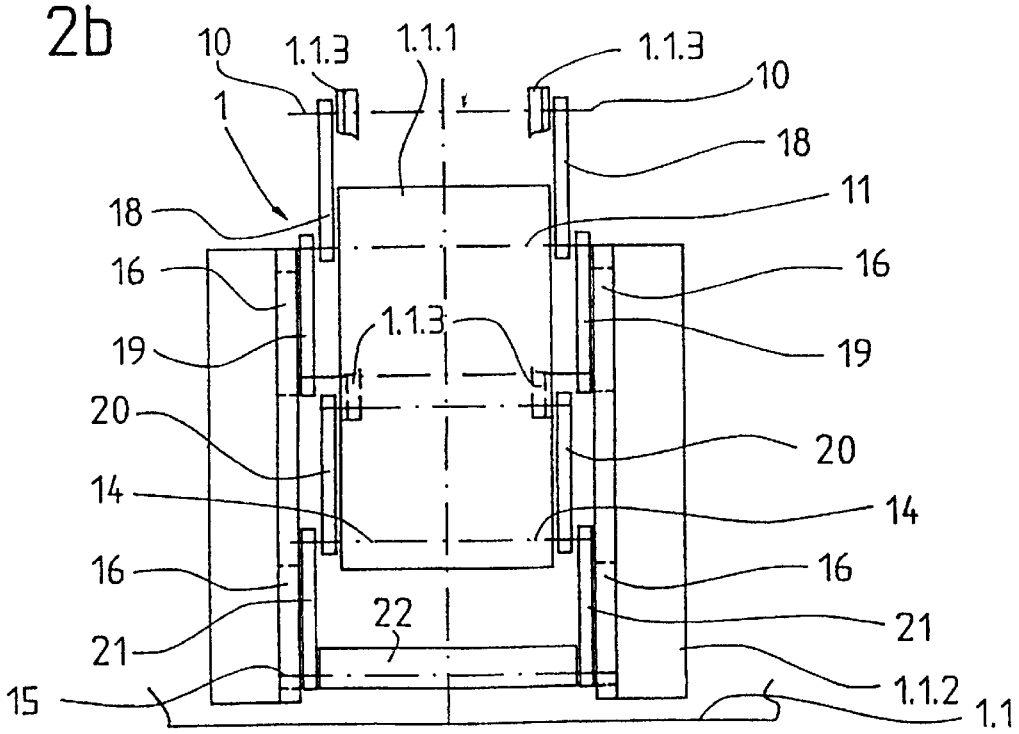
FIG. 2*b* A plan view of the motive mechanism of the operating system.
Figure 2C:
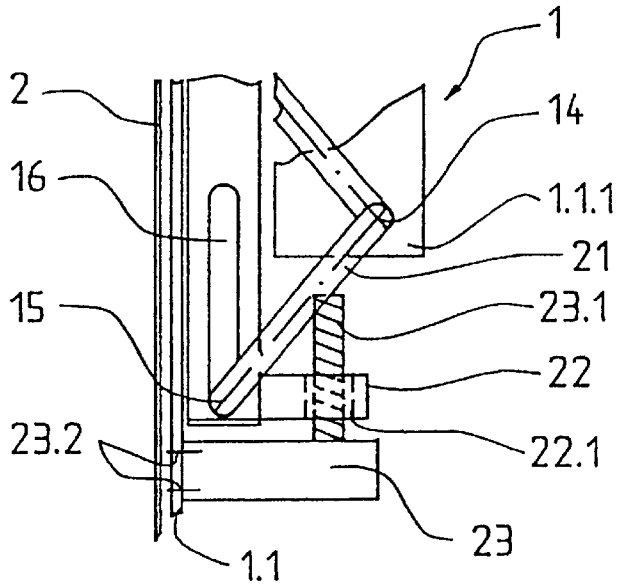
FIG. 2*c* A side view of a drive of the motive mechanism.
Figure 2D:
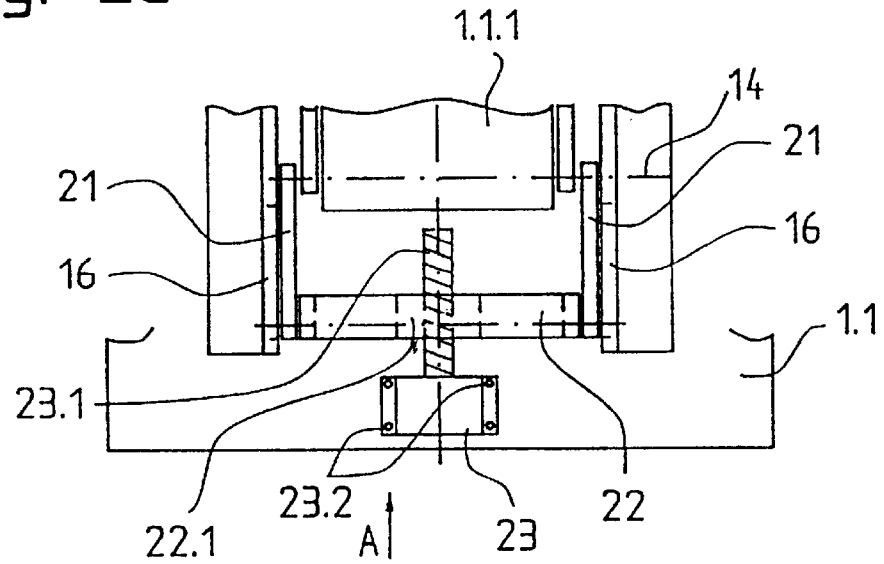
FIG. 2*d* A plan view of the drive of the motive mechanism.
Figure 2E:
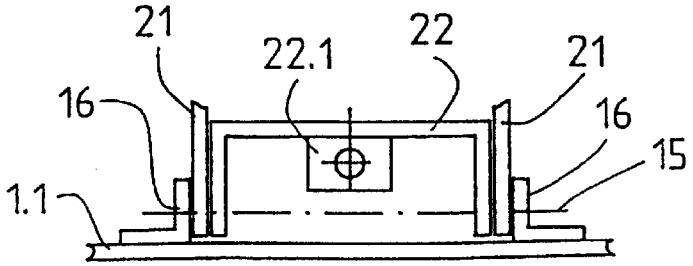
FIG. 2*e* An elevation A of the drive of the motive mechanism.

FIG. 2 shows a schematic view of the operating system 1. FIG. 2*a* and FIG. 2*b* show the motive mechanism of the operating system illustrated schematically in FIG. 2. FIG. 2*c*, FIG. 2*d*, and FIG. 2*e* show the drive of the motive mechanism. The operating system 1 mounted on the car door 2 is movably connected to a linkage rail 1.1.3 at linkage points 10, 11, 12, 13, 14, 15. The linkage points 12, 15 can also be moved on sliding tracks 16 of a sliding-track support rail 1.1.2. The linkage points 10, 11 are movably joined by means of a first connecting rod 18; the linkage points 11, 12 are movably joined by means of a second connecting rod 19; the linkage points 13, 14 are movably joined by means of a third connecting rod 20; and the linkage points 14, 15 are movably joined by means of a fourth connecting rod 21. Mounted on the linkage points 11, 14 is a casing 1.1.1 of the operating system 1. A first actuator 23, consisting, for example, of an alternating current motor with a threaded spindle, engages with a lever 22, which is connected at right angles to the linkage/sliding point 15. The actuator 23 is fastened to the base plate 1.1 at fastening points 23.2, and drives a threaded spindle 23.1 which is connected to a threaded nut 22.1 mounted on the lever 22. The lever 22 carries out a horizontal movement HB. As a result, the operating system 1 is displaced by a first distance 30 in the X direction, and by a second distance 30.1 in the Y direction, as determined by the lever geometry. While the operating system 1 moves, it does so towards an end position 31, and a first measuring distance 32 from a contact surface 4.1 of the operating cam 4 is measured by means of an X sensor 34, which may be, for example, an infrared, laser, or ultrasonic sensor. If the predefined first measuring distance 32 has been reached, the operating system 1 remains in the working position represented by a continuous line. If the first measuring distance 32 has not been reached, or if a specified tolerance value is fallen below, the first actuator 23 is activated by means of an X sensor and an operating controller 50, as a result of which the operating system 1 is adjusted until the specified first measuring distance 32 is reached.

While the first measuring distance 32 is being reached, and during any necessary correction by the X sensor 34, a Y sensor 33 measures a second measuring distance 32.1 from a sliding surface 4.2 of the operating cam 4. The operating controller 50 checks whether the prespecified second measuring distance 32.1 has been reached. If the prespecified second measuring distance 32.1 has been reached, no correction is made. However, if measurement of the distance detects a deviation, the current value of the second measuring distance 32.1 is stored in the memory of the operating system as the door-edge correction value, and used in the manner described later for positioning the car door edge and hoistway door edge.

Figure 3:
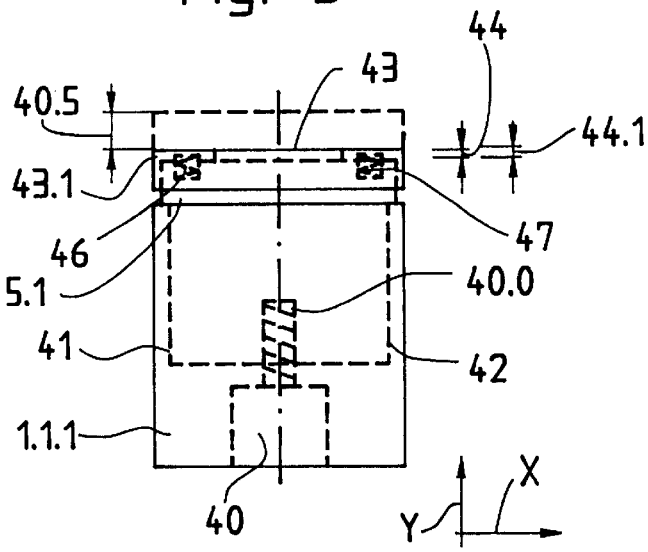
FIG. 3 Details of the operating system for mounting a magnet carrier.
Figure 3A:
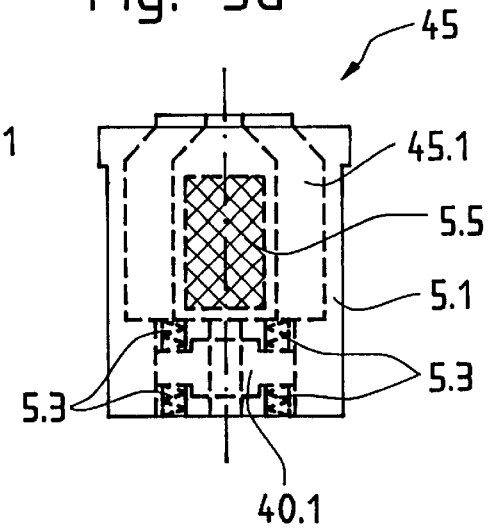
FIG. 3*a* Details of the magnet carrier.

FIG. 3 and FIG. 3*a* show a magnet carrier 5.1, which is mounted in the casing 1.1.1 of the operating system 1, and which has mounted on it a slide 43.1 which can be moved in guides 41, 42. After the second measuring distance 32.1 has been reached, the magnet carrier 5.1 is moved by means of a second actuator 40 in the Y direction in the guides 41, 42 of the casing 1.1.1 until the slide 43.1 rests against a surface 43 on the sliding surface 4.2 of the operating cam 4, the slide 43.1 being elastically supported relative to the magnet carrier 5.1 by means of spring elements 46, 47, and the spring elements 46, 47 being pressed together in such a way that a magnet taking the form, for example, of an electromagnet 45, has reached a prespecified first distance 44. By means of the Y sensor 33, the operating system monitors this increase in proximity, and switches off the second actuator 40 as soon as the prespecified first distance 44 is reached. The operating system then switches on the electromagnet 45, which consists of a magnet body 45.1 and a magnetizing coil 5.5, and which links the operating system 1 to the sliding surface 4.2 of the operating cam 4 by means of an adhesive force which is regulated by the operating controller 50. The sensors 33, 34 are mounted in the slide 43.1 mentioned above.

Figure 3B:
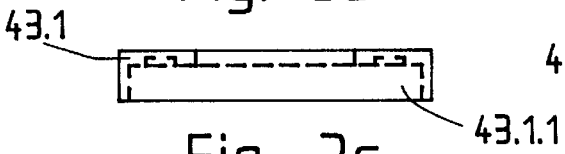
FIG. 3*b* An elevation of a slide mounted on the magnet carrier.
Figure 3D:
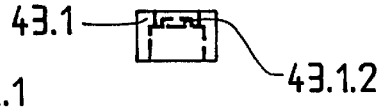
FIG. 3*d* A side view of the slide mounted on the magnet carrier.
Figure 3C:
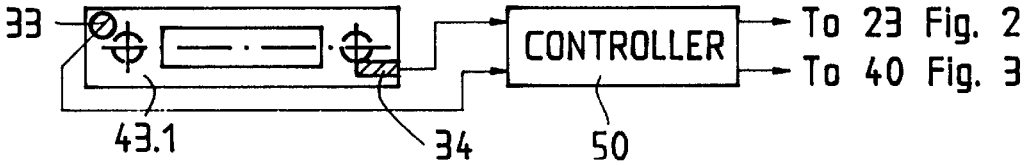
FIG. 3*c* A plan view of the slide mounted on the magnet carrier.

FIG. 3*b*, FIG. 3*c* and FIG. 3*d* respectively show an elevation, a plan view, and a side view of the slide 43.1, on which there is a recess 43.1.1 for the magnet carrier 5.1, and centering holes 43.1.2 for the springs 46, 47. FIG. 3*c* shows the respective positions of the Y sensor 33 and the X sensor 34 which are, for example, cast in the slide 43.1.

Following the magnetic coupling of the car door 2 with the hoistway door 3, the door drive is activated and the doors are moved in the direction of opening OE. During the opening movement of the car door 2 and the hoistway door 3, the operating controller checks whether, while the operating system 1 was moving towards the operating cam 4, a second measurement distance 32.1 was stored in the memory of the operating controller as a door-edge correction value, as described earlier. If no door-edge correction value has been stored, the door edges of the car door 2 and the hoistway door 3 correspond, and their respective edges are parallel and abreast. If deviations within allowed tolerances, caused for example by uneven loading of the elevator car AU, have caused a second measuring distance 32.1 to be stored, the second actuator 40 adjusts the magnet carrier 5.1 until the door edges of the car door 2 and the hoistway door 3 are again parallel and abreast. This correction of deviations within allowed tolerances is necessary so that the respective leading edges of both the door panel of the car door 2 and of the hoistway door 3 are abreast and move parallel to each other.

During the entire opening process, and while the open doors 2, 3 are parked in the open position, and during the closing process, the electromagnet 45 is switched on, and the doors 2, 3 are coupled by means of magnetic adhesion force. The magnetic force of the electromagnet 45 is designed to be of such an intensity that, even at maximum acceleration of both doors 2, 3 in the direction of opening OE, the adhesive force of the electromagnet 45 is in all cases sufficient to move the hoistway door 3 by means of the door drive.

In FIG. 3 and FIG. 3*a*, 40.5 indicates the stroke of the second actuator 40, and 44.1 indicates the compression stroke of the slide 43.1, which is essentially determined by the spring elements 46, 47. A threaded spindle 40.0 of the second actuator 40 engages in a spindle nut 40.1 mounted on the magnet carrier 5.1, the rotational motion of the threaded spindle being thereby converted into a linear movement of the magnet carrier 5.1. The spindle nut 40.1 is held movably in place on the magnet carrier 5.1 by means of compression springs 5.3.

Figure 4:
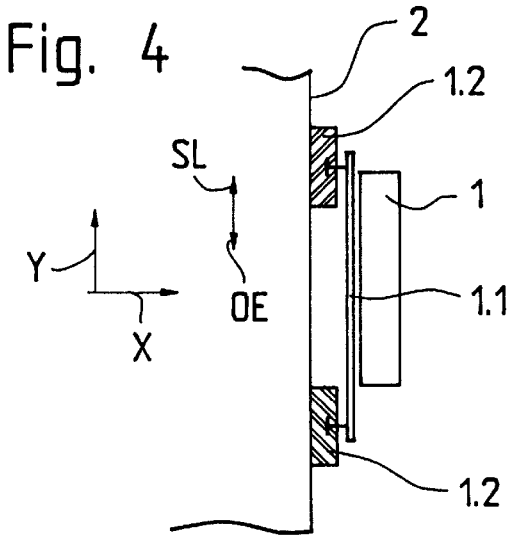
FIG. 4 A base plate fastened on the car door.
Figure 4A:
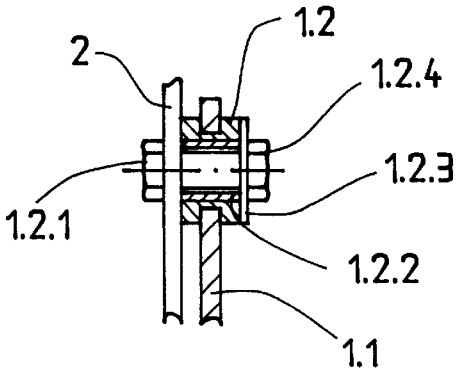
FIG. 4*a* Details of the fastening of the base plate.
Figure 5:
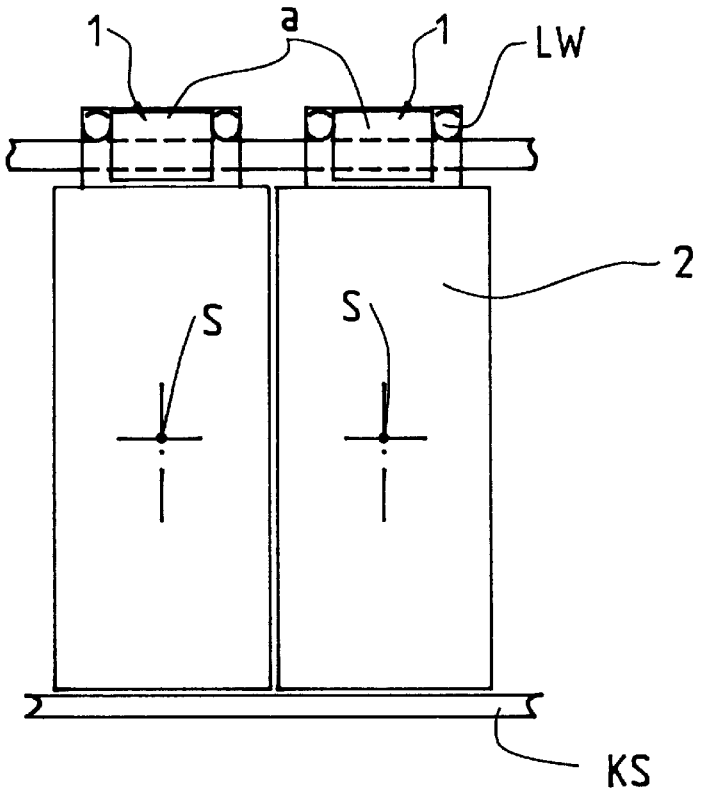
FIG. 5–7 Alternative positions of the operating system on the car door.
Figure 5A:
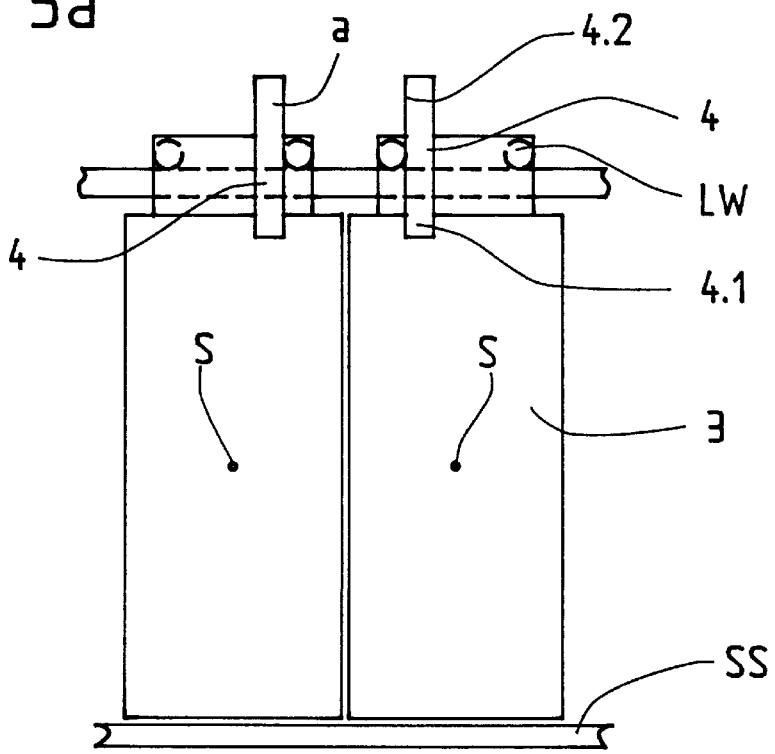
Figure 6:
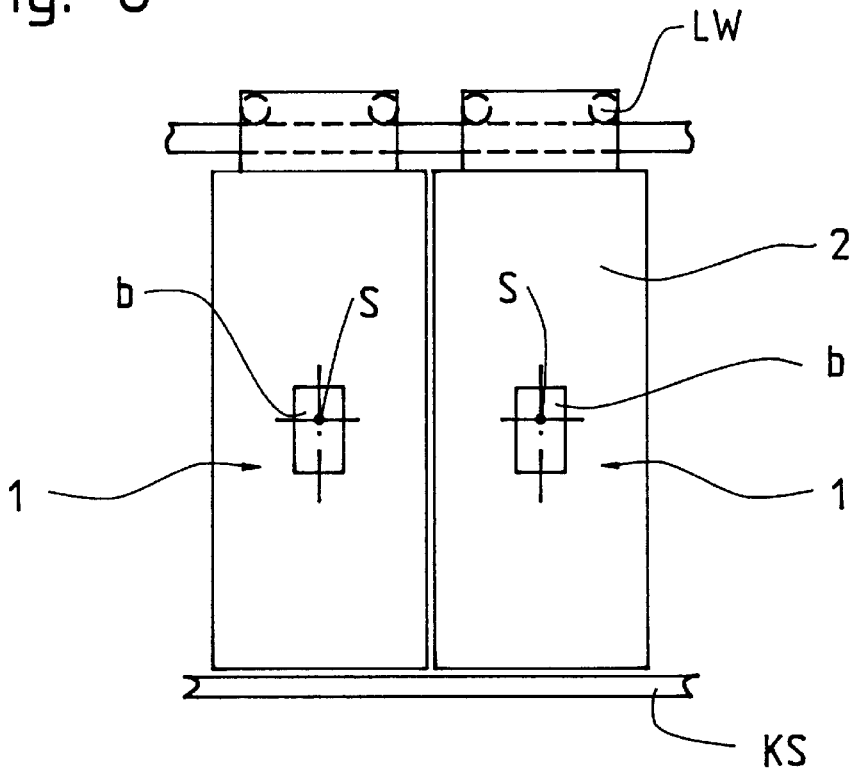
Figure 6A:
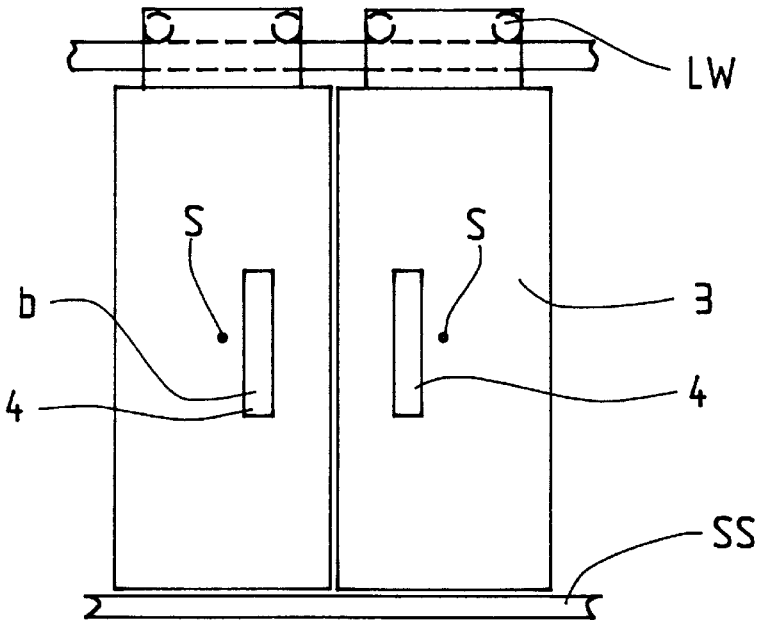
Figure 7:
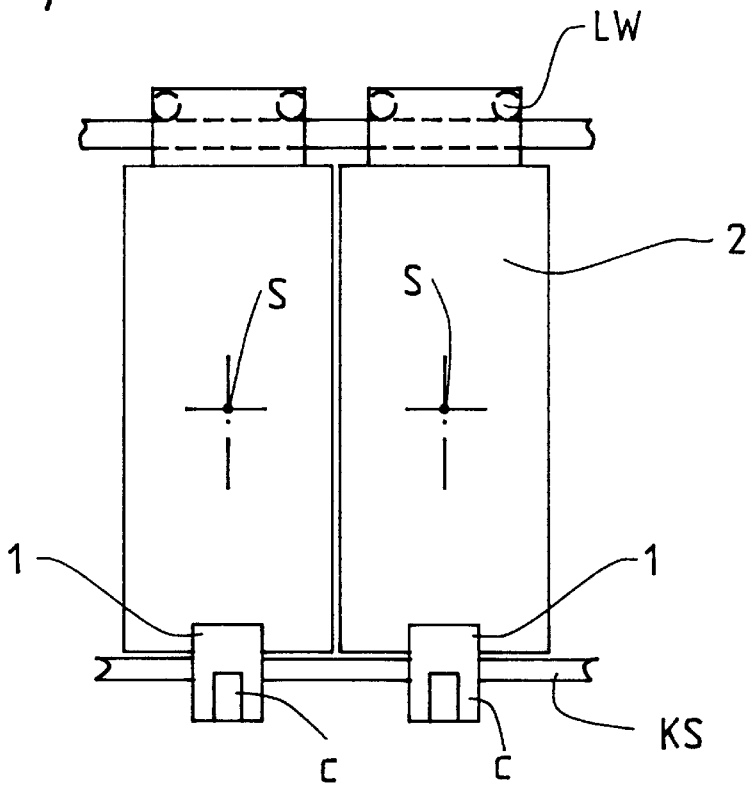
Figure 7A:
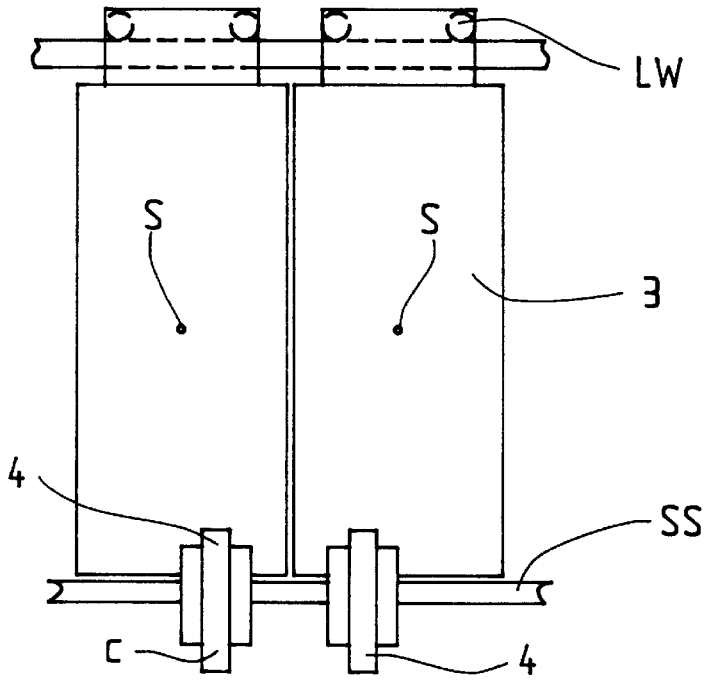

FIG. 4 and FIG. 4*a* show a base plate 1.1 which is mounted on the car door 2 and which carries the operating system 1. To prevent jamming between the movable elevator car AU and car door 2, and the hoistway door 3 and operating system 1, which are fixed in the elevator hoistway, the base plate 1.1 is movably fastened to the car door 2 by means of elastic elements 1.2. These elastic elements are designed in such a way that they can withstand transverse forces in the Y direction without the operating system 1 moving in the X direction by an excessive amount. Futhermore, in the door-open position of the car door 2 and hoistway door 3, the operating controller causes the magnetic force between the electromagnet 45 and the operating cam 4 to be reduced in such a way that only the minimum holding force is produced which prevents the hoistway door 3 from being closed by the closing force specified by regulations. As a result of this reduction in adhesive force, it then becomes easily possible for the operating system 1, or the surface 43 of the slide 43.1, to move to correspond with the necessary upward or downward movement of the operating cam 4 on the sliding surface 4.2 under different loading conditions, for example.

The base plate 1.1 which may, for example, be rectangularly shaped, rests at its corners on the elastic elements 1.2. As shown in FIG. 4*a*, an elastic element 1.2 is fastened to the car door 2 by means of a bolt 1.2.4 and a nut 1.2.1. A distance sleeve 1.2.2 which passes through the elastic element 1.2 serves as a spacer, and a lock washer 1.2.3 serves as a bearing surface and lock for the screw 1.2.4.

The door drive initiates the closing procedure of the car door 2 and the hoistway door 3. During the closing movement, the door-edge correction, which was caused by the presence of deviations within allowable tolerances, is returned by the second actuator 40 to the specified value of the second measuring distance 32.1. As a result of the travel curve characteristic of the door drive, the closing speed toward the end of the travel of the doors 2, 3 is reduced toward 0 m/s, so that the doors 2, 3 come to rest in exactly the predefined position. If no deviations between the car door edge and the hoistway door edge have been caused by the loading conditions, the electromagnet 45 is switched off when the door reaches the closed position. Both doors 2, 3 are closed.

If the door edge of the hoistway door 3 lags behind the door edge of the car door 2, then when the electromagnet 45 is turned off, the hoistway door 3 continues to travel further by the amount of the deviation present, and closes. If there is a deviation of the door edges in the opposite direction, so that the hoistway door 3 reaches its end position before the car door 2, the increasing compressive force on the slide 43.1 is absorbed by the compression springs 5.3.

If the magnetically coupled doors 2, 3 are closed again, the electromagnet is switched off again, as a result of which the magnetic force fades. The second actuator 40 pulls the magnet carrier 5.1 into a specified parking position, and the first actuator 23 moves the operating system 1 into a parking position also. In the parking position, the operating system 1 is pulled back against the car door 2, so that the gap 5 between the car door sill and the hoistway door sill is largely free. While the elevator car AU is travelling along the elevator hoistway, contact of the operating system 1 with the hoistway door sill is completely ruled out, even in the presence of dynamic travel movement of the elevator car AU. The parking position of the operating system 1 is secured by means of a retaining spring 6, so that the operating system 1 cannot leave its parking position even if there is a power failure in the elevator system.

The parking position of the operating system 1, and the operating cam 4 that projects into the gap 5, are adapted to each other in such a way that in an emergency, with the elevator car AU standing in the unlocking zone, the hoistway door 3 can be opened using the emergency interlock release, without the car door 2 also being opened by the operating cam 4. The operating system 1 and the operating cam 4 can be caused to travel past each other without contact occurring. This characteristic has the consequence that, at a landing with the hoistway door 3 open, the operating system 1 can be easily accessed and maintained without the need to move the elevator car AU to decouple the doors 2, 3 in the manner necessary with conventional operating systems having parallelogram couplers.

Depending on the length of the operating cam 4, pre-opening of the doors 2, 3 can be initiated at any point within the allowable unlocking zone. As described above, the operating system 1 is moved to the measuring distances 32, 32.1 by the actuators 23, 40, the operating system 1 comes to rest against the operating cam 4, the electromagnet 45 is switched on, and the magnetic force acts on, and magnetically couples, the operating system 1 and the operating cam 4. While this process takes place in the unlocking zone approximately 12 to 15 cm in advance of the landing position, the elevator car AU moves in the elevator hoistway with decreasing speed. Supported by the force of the spring elements 46, 47, the slide 43.1 rests with its sliding surface 43 against the sliding surface 4.2 of the operating cam 4. By suitably selecting the material of the slide 43.1, for example polyethylene, a noise-free, practically frictionless, non-abrading movement of the operating system 1 on the operating cam 4 is assured.

During leveling at a landing, within the allowable door unlocking zone, the magnetic force of the electromagnet 45 can also be slowly adjusted to increase, so that during this phase of upward or downward movement optimal sliding of the slide 43.1 on the sliding surface 4.1 of the operating cam 4 is possible.

FIGS. 5–7 and FIGS. 5*a*–7*a* show alternative ways of arranging the operating system 1, and the operating cam 4, on the car door 2, and the hoistway door 3, respectively. The doors 2, 3 are, for example, constructed as two-panel doors opening from the center. In arrangement a, the operating system 1 and the operating cam 4 are mounted in the area of the upper carrier LW. In arrangement b, the operating system 1 and the operating cam 4 are fastened on the door panels at the height of the center of gravity S, so as to avoid unnecessary momentary stresses on the door guides. In arrangement c, the operating system 1 and the operating cam 4 are mounted in the area of the door sills KS and SS respectively.

What is claimed is:

1. An operating system for elevator doors comprising: a magnet which is movably mounted on a car door and which acts with its magnetic field on a magnetizable operating cam mounted on a hoistway door, said magnet being mounted on the car door in such a manner as to be horizontally movable relative to the car door.

2. The operating system according to claim 1 characterized in that said magnet can be moved horizontally in both X and Y directions by means of a drivable motive mechanism.

3. The operating system according to claim 2 characterized in that sensors are provided which measure a distance of said magnet in the X direction from said operating cam and a distance of said magnet in the Y direction from said operating cam respectively.

4. The operating system according to claim 3 characterized in that pairs of connecting rods are provided which can be driven by a first actuator, there being a casing mounted at a linkage point of the connecting rod pair which carries out a movement in the X and Y directions and that the connecting rod pairs are mounted by means of a linkage rail and a sliding-track support rail on a base plate which is connected in an elastically isolated manner with the car door.

5. The operating system according to claim 4 characterized in that in said casing there is a magnet carrier which has said magnet and which can be moved by means of a second actuator.

6. The operating system according to claim 5 characterized in that said first and second actuators are motors having threaded spindles, a threaded spindle of said first actuator being connected by means of a threaded nut to a lever mounted on a linkage point, and a threaded spindle of said second actuator being connected to a threaded nut mounted on said magnet carrier.

7. The operating system according to claim 5 characterized in that said magnet carrier has movably mounted on it a slide, such that when the car and hoistway doors are in the coupled state, a surface of said slide rests against a sliding surface of said operating cam, and in that said sensors are mounted on said slide.

8. The operating system according to claim 5 characterized in that there is an operating controller which, by means of signals from said sensors, controls said actuators, and moves said magnet carrier with said magnet to a predefined first measuring distance in the X direction, and a predefined second measuring distance in the Y direction.

9. The operating system according to claim 8 characterized in that said operating system, in the case of deviations, corrects the second measuring distance by means of said second actuator to the predefined second measuring distance, thereby bringing edges of the car doors abreast.

10. The operating system according to claim 8 characterized in that while the elevator car is leveling-in to a landing, and within an allowable unlocking zone, a magnetic force of said magnet can be adjusted by means of said operating controller so that during this phase of upward or downward movement it is possible for said slide to slide on said sliding surface of said operating cam.

* * * * *